US005592973A

United States Patent [19]

Pope

[11] Patent Number: 5,592,973

[45] Date of Patent: Jan. 14, 1997

[54] PRESSURE CAPTURE VALVE

[76] Inventor: Kenneth E. Pope, Box 217, Rte. 3, Wagoner, Okla. 74467

[21] Appl. No.: 491,400

[22] Filed: Jun. 19, 1995

[51] Int. Cl.[6] ..... F16K 31/00; F15B 11/08

[52] U.S. Cl. ..... 137/625.21; 91/382; 91/467

[58] Field of Search ..... 137/625.21, 625.22; 91/382, 467

[56] References Cited

U.S. PATENT DOCUMENTS

| | | | |
|---|---|---|---|
| 3,023,779 | 3/1962 | Cinnirella | 137/625.22 X |
| 3,222,995 | 12/1965 | Reed | 91/382 X |
| 3,504,705 | 4/1970 | Wight et al. | 137/625.21 X |
| 4,591,320 | 5/1986 | Pope | 417/390 |
| 4,825,745 | 5/1989 | Kuttruf | 91/382 X |
| 5,056,414 | 10/1991 | Fuchs | 91/382 X |

FOREIGN PATENT DOCUMENTS

| | | | |
|---|---|---|---|
| 775934 | 1/1968 | Canada | 137/625.21 |
| 0120581 | 5/1990 | Japan | 137/625.21 |

*Primary Examiner*—Hoang Nguyen
*Attorney, Agent, or Firm*—Frank J. Catalano; Scott R. Zingerman

[57] ABSTRACT

A valve has a first set of passages for simultaneously connecting an inlet of a first chamber hydraulically to a source of fluid under pressure and an outlet of a second chamber hydraulically to a venting tank and a second set of passages for simultaneously connecting an inlet of the second chamber hydraulically to the source of fluid under pressure and an outlet of the first chamber hydraulically to the venting tank. The sets of passages are sequentially repositioned to alternately cyclically connect and interrupt hydraulic communication through them. The first and second sets of passages are so configured in relationship to the inlets and outlets that flow through one set is completely terminated only after flow in the other set is initiated.

21 Claims, 6 Drawing Sheets

PRESSURE CAPTURE VALVE

BACKGROUND OF THE INVENTION

This invention relates generally to pumping apparatus and more particularly concerns shift valves for submersible downhole pumps.

In my earlier U.S. Pat. No. 4,591,320, issued May 27, 1986 and entitled "Submersible Pumping Unit," a submersible pump provided greatly increased efficiency over previously known submersible pump systems. The improved system uses one of various embodiments of a shift valve assembly to activate a shift rod assembly which in turn transmits reciprocating motion to a piston rod. The piston rod cooperates with a product valve to suck product from the well and push it up the annulus.

While this improved unit of my earlier patent provided greatly improved efficiency over previously known downhole pump systems, the switching time from up-stroke to downstroke of the piston rod approximates twenty to twenty-five milliseconds, allowing the product in the annulus to initiate downward motion between every pump stroke, thus limiting the increased efficiency of the system. This downward flow occurs because an off condition between every positive and negative operation of the shift valve completely interrupts the flow of working fluid driving the piston rod between every stroke of the rod.

If the upward flow of product is maintained relatively constant, this limitation of efficiency resulting from the downward flow of product can be avoided. It is, therefore, a primary object of this invention to provide a shift valve which minimizes the time between up and down strokes of the piston rod. It is a further object of this invention to provide a shift valve which does not have an off condition between positive and negative strokes. Another object of this invention is to provide a shift valve which increases the efficiency of known submersible pumping units.

SUMMARY OF THE INVENTION

In accordance with the invention, a valve has a first set of passages for simultaneously connecting an inlet of a first chamber hydraulically to a source of fluid under pressure and an outlet of a second chamber hydraulically to a venting tank and a second set of passages for simultaneously connecting an inlet of the second chamber hydraulically to the source of fluid under pressure and an outlet of the first chamber hydraulically to the venting tank. The passages are sequentially repositionable to alternately cyclically connect and interrupt hydraulic communication through the first and second sets of passages. The first and second sets of passages are so configured in relationship to the inlets and outlets that flow through one set is completely terminated only after flow in the other set is initiated.

The valve which, in one application, hydraulically connects and disconnects the first and second chambers to and from the source of fluid under pressure and the vent tank preferably includes a body having a cylindrical bore and a spool rotatively mounted in the body. The first set of passages extends through the body and the spool to simultaneously hydraulically connect the source to the first chamber and the tank to the second chamber in a first rotational registration of the spool within the body. The second set of passages extends through the body and the spool to simultaneously hydraulically connect the source to the second chamber and the tank to the first chamber in a second rotational registration of the spool within the body. A motor applies rotational force to the spool. A continuous cam groove has at least one portion extending for one arcuate interval at a first circumferential level on the spool and another portion extending for another arcuate interval at a second circumferential level on the spool. A cam follower engaged in the groove is reciprocally cyclically driven between the first and second circumferential levels to permit the spool to be rotated to and from the first and second registrations in response to the motor in sequential arcuate intervals.

In a specially preferred embodiment, the first set of passages extends through the body and the spool to simultaneously hydraulically connect the source to the first chamber and the tank to the second chamber in first and third rotational registrations of the spool within the body and the second set of passages extends through the body and the spool to simultaneously hydraulically connect the source to the second chamber and the tank to the first chamber in second and fourth rotational registrations of the spool within the body. The first set of passages includes a first passage extending from the source axially in the body, diametrically through a first level of the spool and axially in the body to the first chamber and a second passage extending from the second chamber axially in the spool and radially through a second level of the body to the tank. The second set of passages includes a third passage extending from the source axially in the body, radially through a third level of the spool and axially in the spool to the second chamber and a fourth passage extending from the first chamber axially in the body and diametrically through a fourth level of the spool to the tank.

In this specially preferred embodiment, the rotational registrations occur at 90 degree increments of rotation of the spool within the body.

Preferably, the radial and diametric portions of the passages in the body are circular in cross-section adn the radial and diametric portions of the passages in the spool are of elongated circular cross-section. The elongated circular cross-section preferably extends circumferentially along the spool a distance approximately 25 degrees greater than the circular cross-section extends circumferentially along the spool bore of the body.

Also preferably, the first and second level portions of the passages in the spool are diametrically aligned and the third and fourth level portions of the passages in the spool are diametrically perpendicular to each other and at an angle of 135 degrees relative to the aligned first and second level portions of the passages.

It is further preferred that the radial and diametric portions of the passages in the spool having a shape resulting from penetration of a drill bit through a longitudinal center of the spool and rotation of a longitudinal axis of the drill bit in a counterclockwise direction about the longitudinal center of the spool.

In this specially preferred embodiment, the portions of the first and third passages which extend axially in the body from the source are coincident and have an arcuate cross-section of 45 degrees and the portions of said second and third passages which extend axially in the spool are coincident and concentric within the spool. The spool is rotated in sequential 90 degree intervals by one of a continuous cam groove having first and third 90 degree segments extending at the first circumferential level on the spool and second and fourth 90 degree segments extending at the second circumferential level on the spool.

A guide maintains the cam follower in its reciprocal cyclical motion. Typically, this reciprocal motion is achieved because the first and second chambers are hydraulically separated by a piston and a shift tube coupling the piston to the cam follower cyclically reciprocates the cam follower when the piston attains its maximum upward and downward stroke positions.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
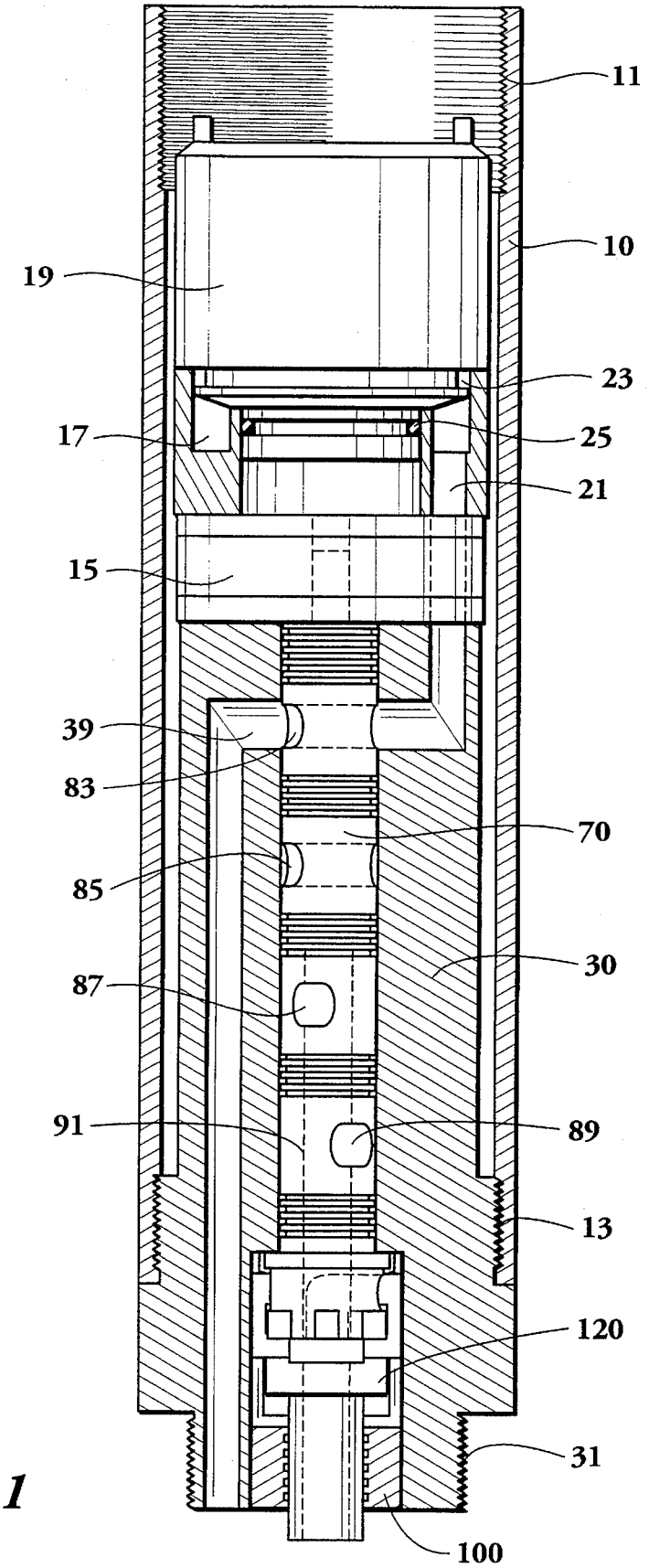
FIG. 1 is a diametric cross-section of a preferred embodiment of the pressure capture valve.

Turning first to FIG. 1, the preferred embodiment of the pressure capture valve is illustrated. A tubular housing 10 is interiorly threaded at its upper and lower ends 11 and 13. A shift valve motor 15 screws into the threaded upper end 11 and a pump adapter 17 on the upper portion of the motor 15 receives a Vickers pump 19 which is also inserted into the upper end 11 of the housing 10. The oil supply from the pump 19 extends through the motor 15 via a working fluid passage 21. The high and low pressure sides of the pump 19 are isolated by O-rings 23 and 25 which also isolate the passage 21. Such motors 15, pump adapters 17 and pumps 19 and their connection and operation are well known.

Figure 2A:
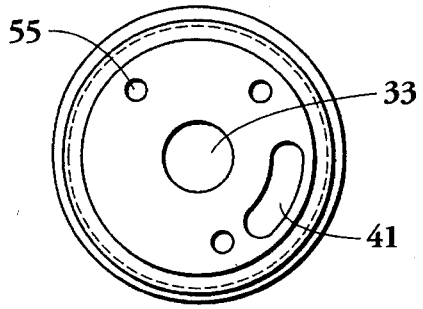
FIG. 2A is a top plan view of the manifold body of FIG. 2.
Figure 2B:
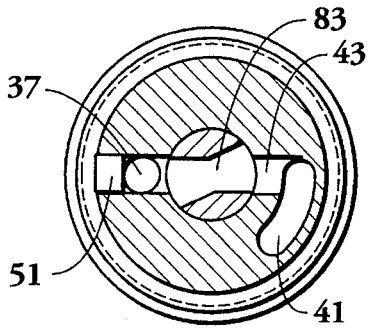
FIG. 2B is a cross-sectional view taken along the line B—B of FIG. 2.
Figure 2C:
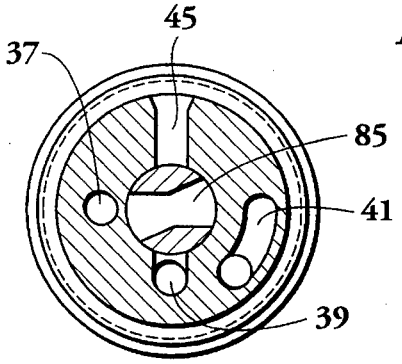
FIG. 2C is a cross-sectional view taken along the line C—C of FIG. 2.
Figure 2:
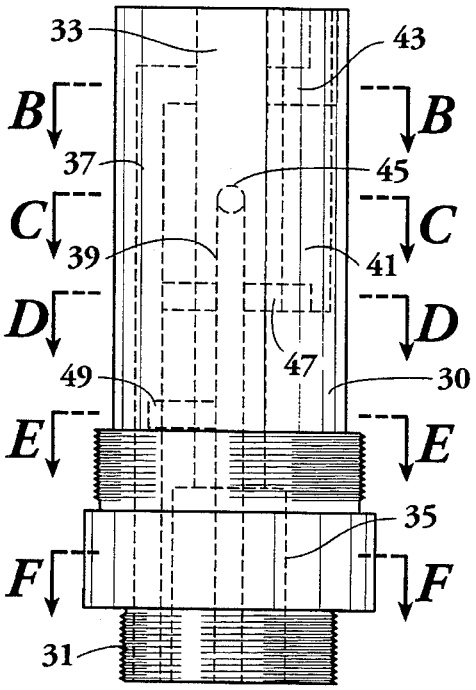
FIG. 2 is a front elevation view of a preferred embodiment of the manifold body of the pressure capture valve of FIG. 1.
Figure 2D:
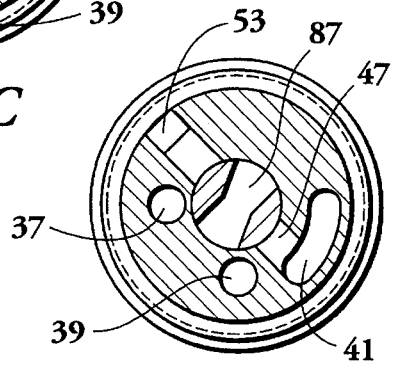
FIG. 2D is a cross-sectional view taken along the line D—D of FIG. 2.
Figure 2E:
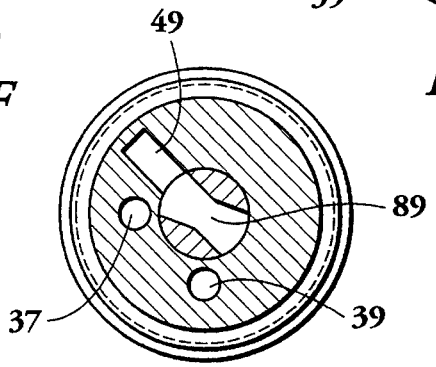
FIG. 2E is a cross-sectional view taken along the line E—E of FIG. 2.
Figure 2G:
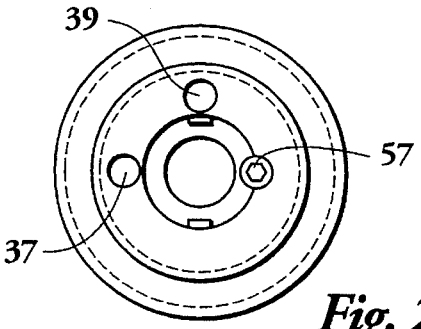
FIG. 2G is a bottom plan view of the manifold body of FIG. 2.
Figure 2F:
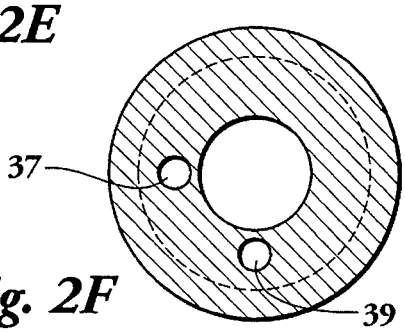
FIG. 2F is a cross-sectional view taken along the line F—F of FIG. 2.

A manifold body 30 threadedly engaged in the lower end 13 of the housing extends upwardly to the motor 15 as illustrated in FIGS. 2 through 2G. The substantially cylindrical manifold body 30 is also exteriorally machined to accommodate threaded connection with a cylinder (not shown) defining a chamber of working fluid. The body 30 has a spool bore 33 extending concentrically for its entire length and a cam guide bore 35 of greater diameter than the spool bore 33 extending concentrically in its lower portion. The body 30 also has three equally radially displaced vertical passages 37, 39 and 41 at ninety degree intervals and four vertically displaced diametric or radial passages 43, 45, 47 and 49 which define a network of switchable flow paths. The diametric passages 43, 45, and 47 extend through the body 30 a sufficient distance to selectively interconnect diametrically opposed vertical passages 37, 39, and 41 and the radial passage 49 extends from the center of the body 30 a sufficient distance to selectively interconnect the spool bore 33 with a selected one of the radially displaced vertical passages 37 or 39. In the preferred embodiment shown, the first vertical supply passage 37 extends from the bottom of the body to the first level horizontal passage 43. The second vertical passage 39 is displaced ninety degrees counterclockwise from the first vertical passage 37 and extends from the bottom of the body 30 to the second level horizontal passage 45. The third vertical passage 41 extends from the top of the body 30 downwardly to the third level horizontal passage 47. The third vertical passage 41 is arcuate in cross-section and extends forty-five degrees from diametrically opposite the first vertical passage 37 in a clockwise direction. With the exception of the third vertical passage 41 which is arcuate, all of the vertical and horizontal passages 37, 39, 43, 45, 47 and 49 are circular boreholes. The drill entry ends of the first horizontal passage 43 and the third horizontal passage 47 are provided with plug welds 51 and 53 to close off these passages 43 and 47 which communicate with supply of the pump 19 from the tank side of the pump 19. The operation of the selected flow paths defined by these passages will be hereinafter explained. As seen in FIG. 2A, the upper face of the body 30 is provided with holes 55 to receive the mounting screws (not shown) associated with the motor 15. As seen in FIG. 2G, the cam guide bore 35 is provided with a semi-circular hole 57 for receiving a set screw (not shown) for purposes to be hereinafter explained.

Figure 3A:
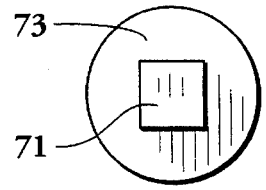
FIG. 3A is a top plan view of the spool of FIG. 3.
Figure 3C:
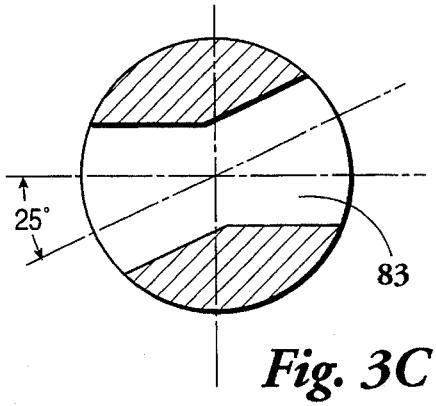
FIG. 3C is a schematic representation of the angular position of a horizontal fluid passage at level C—C of FIG. 3.
Figure 3:
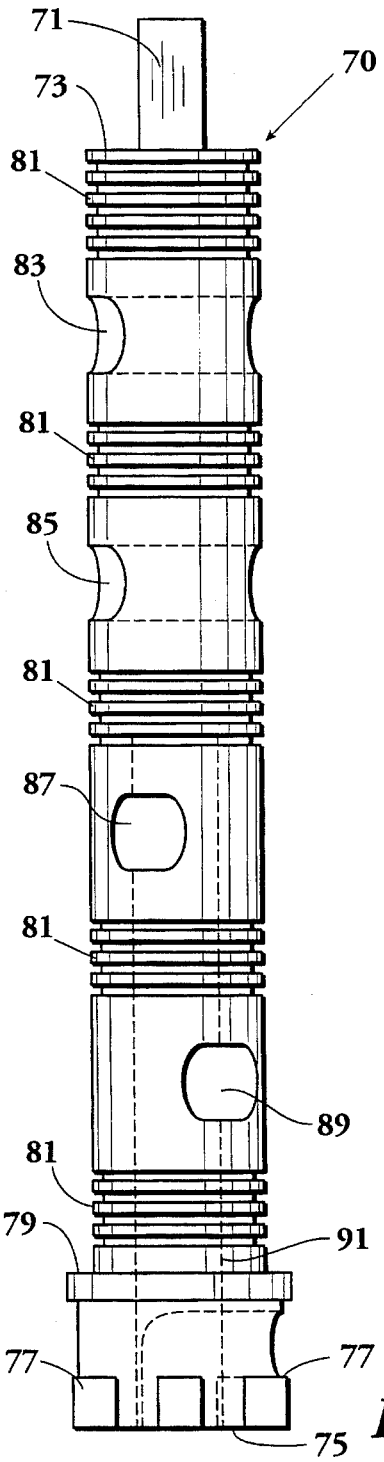
FIG. 3 is a front elevation view of a preferred embodiment of the spool of the pressure capture valve of FIG. 1.
Figure 3D:
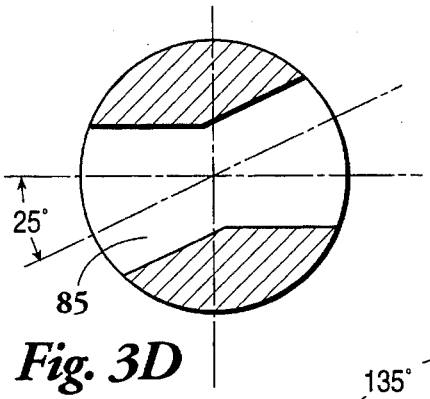
FIG. 3D is a schematic representation of the angular position of a horizontal fluid passage at level D—D of FIG. 3.
Figure 3E:
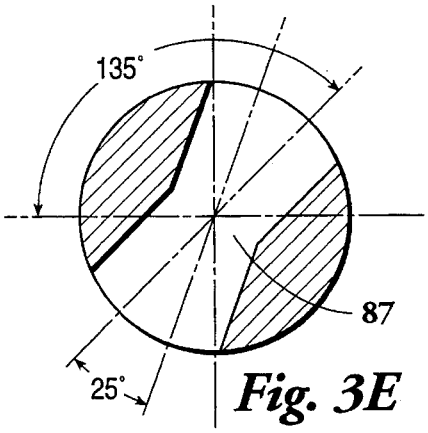
FIG. 3E is a schematic representation of the angular position of a horizontal fluid passage at level E—E of FIG. 3.
Figure 3F:
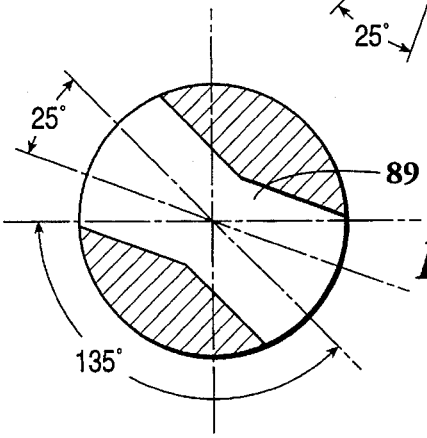
FIG. 3F is a schematic representation of the angular position of a horizontal fluid passage at level F—F of FIG. 3.

Looking at FIGS. 1 and 3 through 3F, a spool 70 disposed in the spool bore 33 of the manifold body 30 is substantially cylindrical and has a drive shaft connector 71 extending from its upper end 73 for connection with the drive socket of the motor 15. The lower end 75 of the spool 70 is provided about its periphery with a plurality of cam grooves 77 dividing the lower end 75 into quadrants. A shoulder 79 separates the cam portion of the spool 70 from its main body. As shown, the main body of the spool 70 is divided into four vertically aligned sections by circumferential grooves or labyrinths 81. The uppermost section is provided with a first diametric passage 83. The next lower section is provided with a second diametric passage 85 aligned with the first. The next lower section is provided with a third diametric passage 87 aligned at an angle of one hundred thirty-five degrees in a clockwise direction from the first and second diametric passages 83 and 85. The lowermost section is provided with a fourth diametric passage 89 which is aligned at an angle of one hundred thirty-five degrees counterclockwise to the first and second diametric passages 83 and 85. A two-way passage 91 is formed by a concentric borehole extending from the lower end 75 of the spool to a level above the third diametric passage 87 so as to provide hydraulic communication between the third, fourth and two-way passages 87, 89 and 91.

Figure 4:
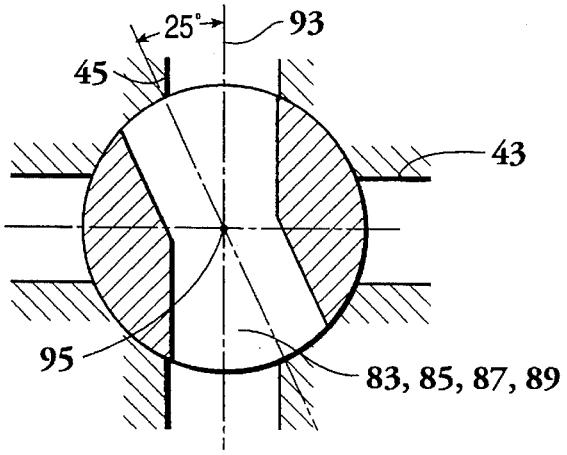
FIG. 4 is a schematic diagram illustrating the continuous flow operation of the pressure capture valve of FIG. 1.
Figure 4A:
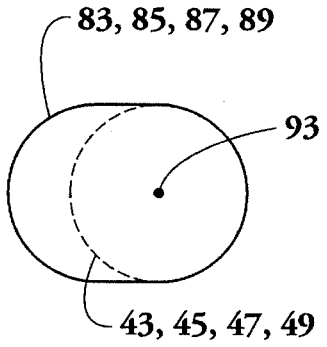
FIG. 4A is a schematic diagram illustrating the cross-sectional relationships of the flow passages shown in FIG. 4.

As shown in FIGS. 4 and 4A, the diametric passages 83, 85, 87 and 89 extending through the spool 70 consist of diametric boreholes of diameter substantially equal to the diameter of the horizontal passages 43, 45, 47 and 49 in the manifold body 30. However, with the borehole diametrically complete, the longitudinal axis 93 of the drill bit (not shown) is rotated about the longitudinal axis 95 of the spool 70 for a distance of twenty-five degrees to widen the passages 83, 85, 87 and 89 along the circumference of the spool 70. The positions of the spool passages 83, 85, 87 and 89 are illustrated in FIGS. 2B through 2E in a zero degree reference position relative to the manifold body 30. It will be readily noted in FIG. 4 that, due to the expanded width of the passages 83, 85, 87 and 89 through the spool 70, as the spool 70 is rotated within the manifold body 30, the flow of working fluid within the valve is never completely interrupted.

Figure 5A:
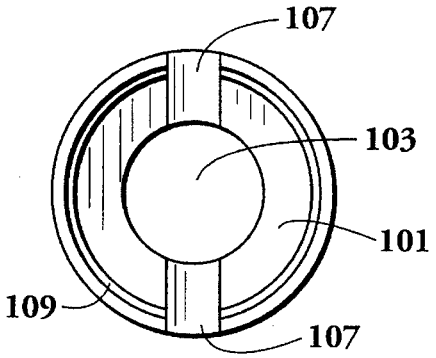
FIG. 5A is a top plan view of the cam guide of FIG. 5.
Figure 5:
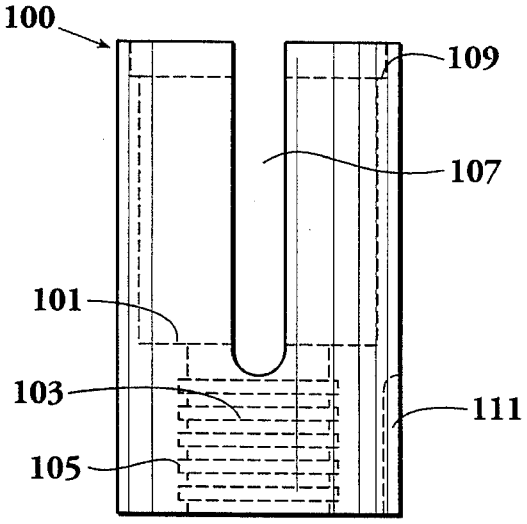
FIG. 5 is a front elevation view of a preferred embodiment of the cam guide of the pressure capture valve of FIG. 1.

A cam guide 100 is illustrated in FIGS. 5 and 5A. The cam guide 100 is substantially a cylindrical member of diameter slightly less than the diameter of the cam guide bore 35 in the body 30. The cam guide 100 has a wide concentric upper bore defining a cam stop seat 101 and a smaller diameter bore 103 extending downwardly from the bottom of the cam stop seat 101 through the lower end of the cam guide 100. The small bore 103 has circumferential grooves or labyrinths 105 machined on its periphery. A pair of diametrically opposed slots 107 through the walls of the cam guide 100 extend from the top of the cam guide 100 to a point slightly below the bottom of the cam stop seat 101. An annular seat 109 is also provided along the upper circumferential edge of the cam guide 100 and a semi-circular bore 111 extends upwardly from the bottom of the cam guide 100 to a point below the bottom of the cam stop seat 101 and circumferentially positioned at a midpoint between the slots 107. As can best be seen in FIG. 2G, the semi-circular bore 111 in the cam guide will mate with the semi-circular bore 57 in the manifold body 30 so that a set screw (not shown) will prevent relative rotational motion of the manifold body 30 and the cam guide 100.

Figure 6A:
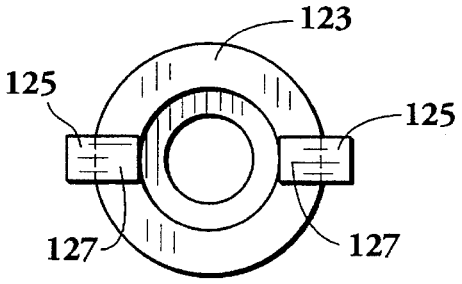
FIG. 6A is a top plan view of the cam stop of FIG. 6.
Figure 6:
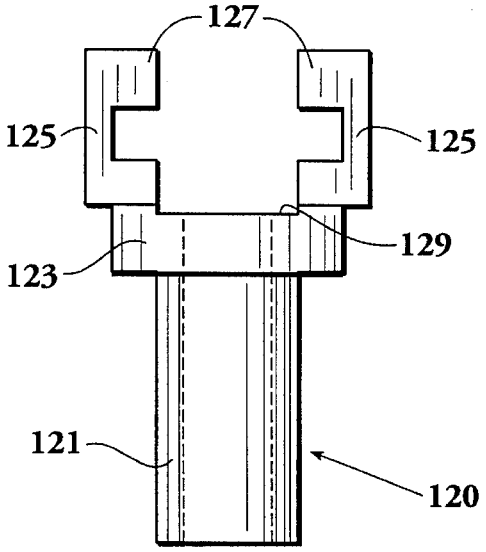
FIG. 6 is a front elevation view of a preferred embodiment of the cam stop of the pressure capture valve of FIG. 1.

A cam stop 120 seated in the cam guide 100 is illustrated in FIGS. 6 and 6A. The cam stop 120 consists of a vertically aligned tube 121 having an outer diameter snugly but slidably received in the small bore 103 of the cam guide 100. The tube 121 has an inner diameter suitable to slidably receive a shift tube (not shown) which will extend through and downwardly below the lower end of the cam stop tube 121. The upper end of the tube 121 is provided with an annular flange 123 of diameter to permit slidably engagement of the flange within the cam stop seat 101 of the cam guide 100. A pair of diametrically opposed cam tongs 125 extend upwardly from the flange 103, the tongs 125 being spaced to ride within the slots 107 of the cam guide 100 to prevent relative rotation of the cam stop 120 within the cam guide 100. The upper portions of the tongs 125 are provided with inwardly extending cam followers 127 which will travel along the face of the cam grooves 77 at the bottom of the spool 70 as shown in FIG. 3. As can best be seen in FIG. 1, a seat 129 in the upper portion of the annular flange 123 receives the upper flanged edge of the shift tube (not shown).

In assembling the valve, with the shift tube disposed in the cam stop tube 121 and against the seat 129, the cam stop 120 is inserted into the cam guide 100 with the tongs 125 sliding in the slots 107. As can best be seen in FIG. 1, the assembled cam guide 100, cam stop 120 and shift tube are inserted into the cam guide bore 35 at the bottom of the manifold body 30 so that the seat 109 at the top of the cam guide 100 engages with the shoulders 79 on the spool 70 shown in FIG. 3. The upper portion of the spool shoulder 79 engages with the upper portion of the cam guide bore 35 when the spool 70 is fully seated in the manifold body 30. The cam followers 127 of the cam stop 120 are engaged in the cam grooves 77 and the set screw (not shown)is inserted between the manifold body 30 and the cam guide 100 to properly align the components and prevent relative rotational motion. The spool 70, however, is free to rotate within the manifold body 30 in ninety degree increments as the cam stop 120 is raised and lowered within the cam guide 100 as a result of upward force exerted on the bottom of the cam stop tube 121 by a rising product piston (not shown) or downward force exerted on the cam stop flange 123 by a falling product piston via the shift tube (not shown) which causes the flange of the shift tube (not shown) engaged in the seat 129 of the cam stop 120 to pull the cam stop 120 in a downward direction.

Figure 3B:
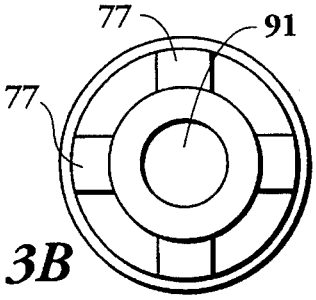
FIG. 3B is a bottom plan view of the spool of FIG. 3.

In operation, looking principally at FIGS. 1, 3 and 3B, if the product piston (not shown) is in an up condition, the force against the bottom of the cam stop tube 121 forces the cam followers 127 into the upper portion of the cam grooves 77, allowing the spool 70 to be rotated ninety degrees by the motor 15. The spool 70 is held in this position until the product piston (not shown) is downwardly driven to align the cam followers 127 with the lower portion of the cam grooves 77, so that the spool 70 can be again rotated ninety degrees by the motor 15 for an additional ninety degree interval. Thus, the spool 70 will be rotated one quarter turn on each up or down stroke of the product piston (not shown). The flow of working fluid in the valve is best understood in relation to FIG. 7. The vertical passages 37, 39, and 41 are shown at their radial distance from the longitudinal axis 131 of the stool 70 which is rotated by the motor 15 in a counterclockwise direction 133 within the spool bores 33. The upper end of the passage 41 hydraulically communicates with the working fluid supply passage 21 as shown in FIG. 1. The first level horizontal passage 43 is available to connect the supply passage 21 to the first vertical passage 37. The second level horizontal passage 45 is available to connect the second vertical passage 39 to tank. The third level horizontal passage 47 is available to connect the supply passage 21 to the two-way passage 91 in the spool 70. The fourth level horizontal passage 49 is available to connect the two-way passage 91 to tank. As shown, when the spool 70 is oriented in its zero reference position, the first spool passage 83 connects the supply passage 21 to the first level horizontal passage 43 to the first vertical passage 37 to supply fluid under pressure to the A chamber 135 of the product piston. At the same time, the fourth level spool passage 89 prevents the B chamber 137 of the product piston through the two-way passage 91 in the spool 70. In the zero reference condition, the second and third passages 85 and 87 through the spool 70 prevent flow at the second and third levels. With the A chamber of the product piston pressurized and the B chamber vented, the piston is downwardly driven to push product up the annulus from the A product chamber and to suck fluid from the well into the B product chamber. When the piston hits the bottom of its stroke, the cam is pulled down as above described and the spool 70 rotates ninety degrees counterclockwise. In this position, the third level diametric passage 87 in the spool 70 connects the vertical supply passage 41 through the two-way passage 91 to provide working fluid under pressure to the B chamber 137 of the product piston. At the same time, the second level aliametric passage 85 through the spool 70 connects the second vertical passage 39 to tank to vent the A chamber 135 of the product piston. In this condition, the piston rises to push product from the B chamber up the annular and to suck product from the well into the A chamber. When the product piston reaches the upper end of its stroke, the cam is again upwardly pushed as above described and the spool 70 will rotate an additional ninety degrees to the one hundred eighty degree position, producing the same condition that existed at the zero degree condition. Similarly, as the process continues, when the spool has rotated two hundred seventy degrees, the same pressure and venting conditions exist as at ninety degrees. On the next operation of the can, the system will be returned to the zero degree condition and the process repeated.

Figure 7:
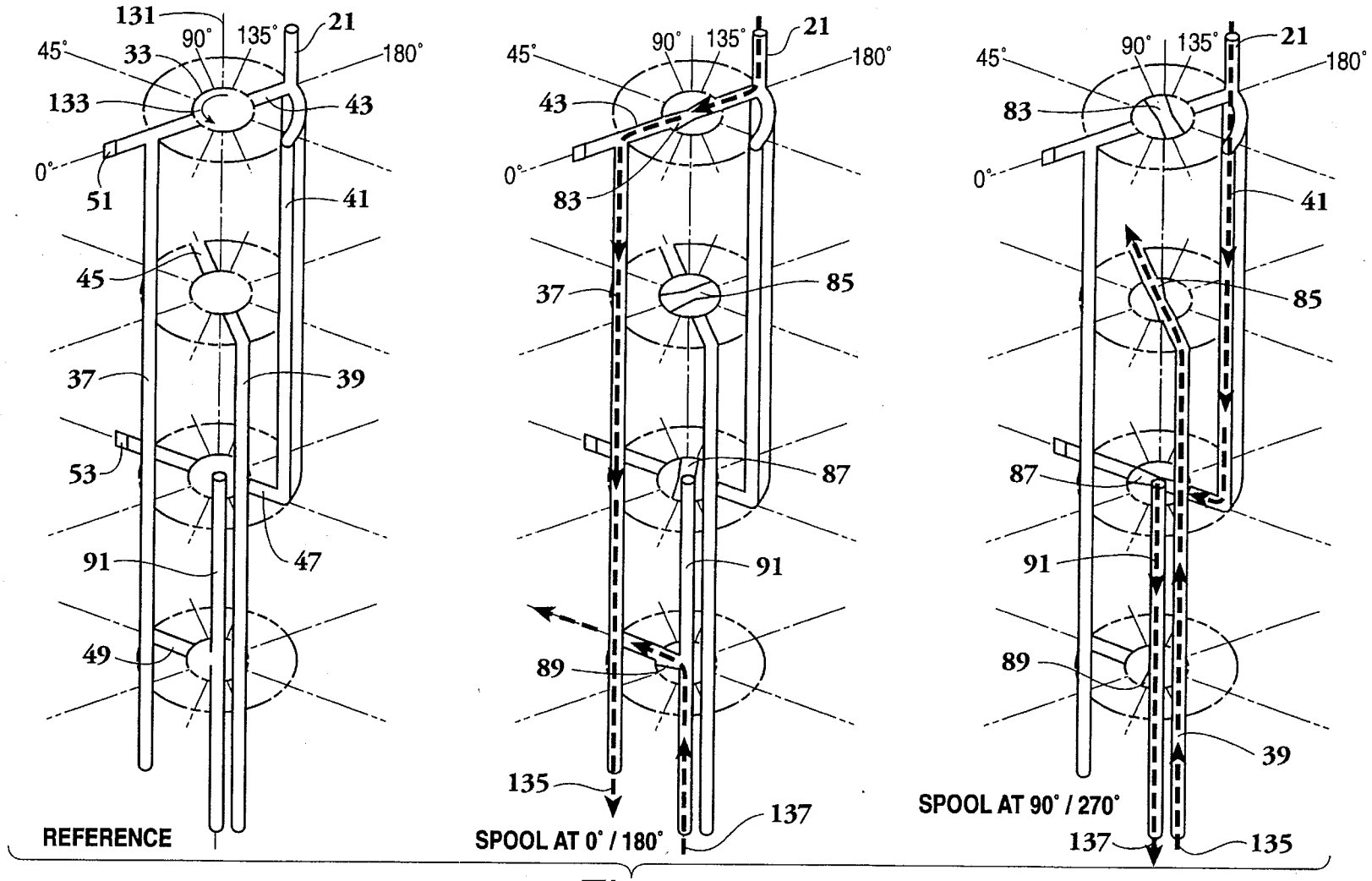
FIG. 7 is a flow diagram illustrating the operation of the pressure capture valve of FIG. 1.
Figure 8:
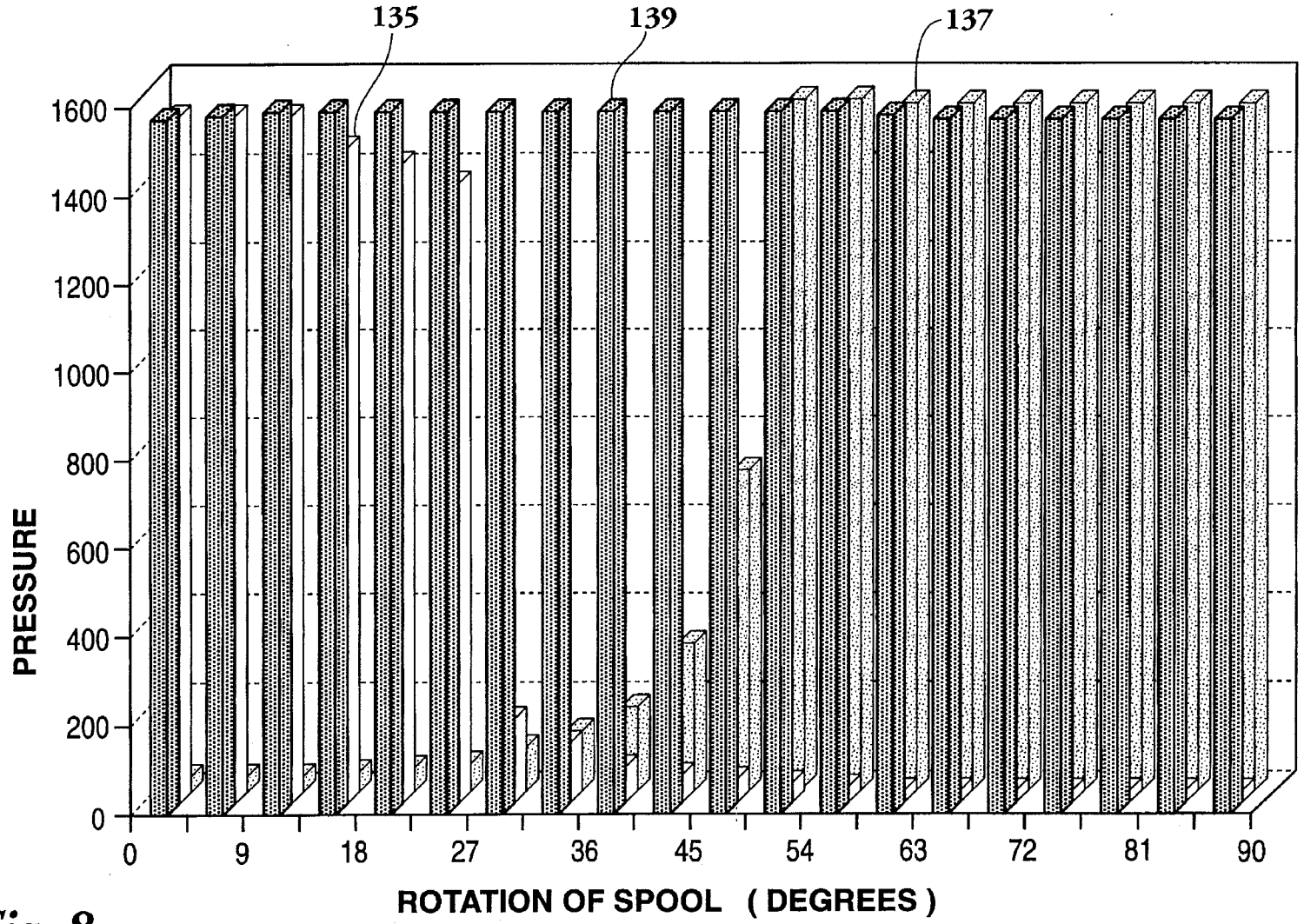
FIG. 8 is a graphic illustration of the constant operating pressure characteristic of the pressure capture valve of FIG. 1.

Looking at FIGS. 4, 4A and 7, as the first level diametric passage 83 through the spool 70 shifts from zero degrees to ninety degrees, the third level diametric passage 87 through the spool 70 simultaneously allows fluid under pressure to be supplied to the B chamber of the product piston because of the extended circumferential length of the passages 83 and 87 through the spool 70, the flow of working fluid is never completely interrupted but briefly simultaneously flows to both chambers. Similarly, both chambers are simultaneously briefly vented. The result is manifested in the graphic representation of FIG. 8 in which the spool rotation of ninety degrees representing a transfer from upstroke to downstroke of the product piston is incrementally divided into twenty-four and one-half degree segments. At each segment, the A chamber pressure 135 is represented by vertically divided bars, the B chamber pressure 137 is represented by horizontally divided bars and the operating pressure 139 of the valve is represented by solid vertical bars. As shown, the valve operating pressure 139 remains relatively constant throughout the cycle while chamber pressure slightly overlaps as the cycle shifts from pressure in one chamber to the other. The transfer time of this cycle approximates two to three milliseconds, a considerable reduction from the twenty to twenty-five milliseconds transition time with known valves. By limiting the transition time to two to three milliseconds, the head and the annulus is not given the opportunity to begin downward movement and therefore constant flow of product through the annulus to the surface of the well is maintained.

Thus, it is apparent that there has been provided, in accordance with the invention, a pressure capture valve that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A valve comprising means having a first set of passages therethrough for simultaneously connecting an inlet of a first chamber hydraulically to a source of fluid under pressure and an outlet of a second chamber hydraulically to a venting tank and a second set of passages therethrough for simultaneously connecting an inlet of the second chamber hydraulically to the source of fluid under pressure and an outlet of the first chamber hydraulically to the venting tank and means for sequentially repositioning said passage means to alternately cyclically connect and interrupt hydraulic communication through said first and second sets of passages, said first and second sets of passages being so configured in relationship to said inlets and outlets that flow through one said set is completely terminated only after flow in the other said set is initiated.

2. A valve for hydraulically connecting and disconnecting first and second chambers to and from a source of fluid under pressure and a vent tank comprising:

a body having a cylindrical bore therein;

a spool rotatively mounted in said body;

a first set of passages extending through said body and said spool for simultaneously hydraulically connecting the source to the first chamber and the tank to the second chamber in a first rotational registration of said spool within said body; and a second set of passages extending through said body and said spool for simultaneously hydraulically connecting the source to the second chamber and the tank to the first chamber in a second rotational registration of said spool within said body;

said passages being of different dimension in said spool than in said body whereby, as said spool rotates to and from said first and second registrations, hydraulic communication through one said set is completely terminated only after hydraulic communication through the other said set is initiated.

3. A valve according to claim 2 further comprising means for applying rotational force to said spool.

4. A valve according to claim 3 further comprising means for permitting said spool to be rotated to and from said first and second registrations in response to said force applying means in sequential arcuate intervals.

5. A valve according to claim 4, said permitting means comprising:

a continuous cam groove having at least one portion extending for one said arcuate interval at a first circumferential level on said spool and at least another portion extending for another said arcuate interval at a second circumferential level on said spool; and a cam follower engaged in said groove and reciprocally cyclically driven between said first and second circumferential levels.

6. A valve for hydraulically connecting and disconnecting first and second chambers to and from a source of fluid under pressure and a vent tank comprising:

a body having a cylindrical bore therein;

a spool rotatively mounted in said body;

a first set of passages extending through said body and said spool for simultaneously hydraulically connecting the source to the first chamber and the tank to the second chamber in first and third rotational registrations of said spool within said body; and a second set of passages extending through said body and said spool for simultaneously hydraulically connecting the source to the second chamber and the tank to the first chamber in second and fourth rotational registrations of said spool within said body;

said passages being of different dimension in said spool than in said body whereby, as said spool rotates sequentially through said registrations, hydraulic communication through one said set is completely terminated only after hydraulic communication through the other said set is initiated.

7. A valve according to claim 6, said first set of passages comprising a first passage extending from the source axially in said body, diametrically through a first level of said spool and axially in said body to the first chamber and a second passage extending from the second chamber axially in said spool and radially through a second level of said body to the tank.

8. A valve according to claim 6, said second set of passages comprising a first passage extending from the source axially in said body, radially through a first level of said spool and axially in said spool to the second chamber and a second passage extending from the first chamber axially in said body and diametrically through a second level of said spool to the tank.

9. A valve for hydraulically connecting and disconnecting first and second chambers to and from a source of fluid under pressure and a vent tank comprising:

a body having a cylindrical bore therein;

a spool rotatively mounted in said body;

a first set of passages extending through said body and said spool for simultaneously hydraulically connecting the source to the first chamber and the tank to the second chamber in first and third rotational registrations of said spool within said body said first set of passages comprising a first passage extending from the source axially in said body, diametrically through a first level of said spool and axially in said body to the first chamber and a second passage extending from the second chamber axially in said spool and radially through a second level of said body to the tank; and a second set of passages extending through said body and said spool for simultaneously hydraulically connecting the source to the second chamber and the tank to the first chamber in second and fourth rotational registrations of said spool within said body said second set of passages comprising a third passage extending from the source axially in said body, radially through a third level of said spool and axially in said spool to the second chamber and a fourth passage extending from the first chamber axially in said body and diametrically through a fourth level of said spool to the tank;

said passages being of different dimension in said spool than in said body whereby, as said spool rotates sequentially through said registrations, hydraulic communication through one said set is completely terminated only after hydraulic communication through the other said set is initiated.

10. A valve according to claim 9, said rotational registrations occurring at 90 degree increments of rotation of said spool within said body.

11. A valve according to claim 10, said radial and diametric portion of said passages in said body being of circular cross-section and said radial and diametric portions of said passages in said spool being of elongated circular cross-section.

12. A valve according to claim 11, said elongated circular cross-section extending circumferentially along said spool a distance approximately 25 degrees greater than said circular cross-section extends circumferentially along said spool bore of said body.

13. A valve according to claim 12, said first and second level portions of said passages in said spool being diametrically aligned and said third and fourth level portions of said passages in said spool being diametrically perpendicular to each other and at an angle of 135 degrees relative to said aligned first and second level portions of said passages.

14. A valve according to claim 13, said radial and diametric portions of said passages in said spool having a shape resulting from penetration of a drill bit through a longitudinal center of said spool and rotation of a longitudinal axis of the drill bit in a counterclockwise direction about said longitudinal center of said spool.

15. A valve according to claim 13, said portions of said first and third passages extending axially in said body from said source being coincident and having an arcuate cross-section of 45 degrees.

16. A valve according to claim 13, said portions of said second and third passages extending axially in said spool being coincident and concentric within said spool.

17. A valve for hydraulically connecting and disconnecting first and second chambers to and from a source of fluid under pressure and a vent tank comprising:

a body having a cylindrical bore therein;

a spool rotatively mounted in said body;

means for applying force to rotate said spool within said body;

a first set of passages extending through said body and said spool for simultaneously hydraulically connecting the source to the first chamber and the tank to the second chamber in first and third rotational registrations of said spool within said body; and a second set of passages extending through said body and said spool for simultaneously hydraulically connecting the source to the second chamber and the tank to the first chamber in second and fourth rotational registrations of said spool within said body;

said passages being of different dimension in said spool than in said body whereby, as said spool rotates sequentially through said registrations, hydraulic communication through one said set is completely terminated only after hydraulic communication through the other said set is initiated.

18. A valve according to claim 17 further comprising means for permitting said spool to be rotated to and from said first and second registrations in response to said force applying means in sequential 90 degree intervals.

19. A valve according to claim 18, said permitting means comprising:

a continuous cam groove having first and third 90 degree segments extending at a first circumferential level on said spool and second and fourth 90 degree segments extending at a second circumferential level on said spool; and a cam follower engaged in said groove and reciprocally cyclically driven between said first and second circumferential levels.

20. A valve according to claim 19 further comprising means for guiding said cam follower in said reciprocal cyclical motion.

21. A valve according to claim 20, the first and second chambers being hydraulically separated by a piston, the valve further comprising means coupling the piston to said cam follower for cyclically reciprocating said cam follower when the piston attains its maximum upward and downward stroke positions.

* * * * *